US005158516A

United States Patent [19]

Johnson

[11] Patent Number: 5,158,516

[45] **Date of Patent: * Oct. 27, 1992**

[54] INVALID GRAVITY FORCE REBOUND EXERCISER

[76] Inventor: William S. Johnson, 37203 SE. Gibson Rd., Washougal, Wash. 98671

[ * ] Notice: The portion of the term of this patent subsequent to Nov. 12, 2008 has been disclaimed.

[21] Appl. No.: 712,733

[22] Filed: Jun. 10, 1991

Related U.S. Application Data

[63] Continuation-in-part of Ser. No. 544,916, Jun. 20, 1990, Pat. No. 5,064,191.

[51] Int. Cl.[5] ..... A63B 21/068

[52] U.S. Cl. ..... 482/95; 482/121; 482/129

[58] Field of Search ..... 272/62, 63, 117, 118, 272/129, 135-143; 482/38, 39, 40, 41, 93, 95, 96, 102, 103, 121-130, 26

[56] References Cited

U.S. PATENT DOCUMENTS

| | | | |
|---|---|---|---|
| 4,021,040 | 5/1977 | Inoue | 272/135 X |
| 4,111,414 | 9/1978 | Roberts | 272/62 |
| 4,199,139 | 4/1980 | Mahnke et al. | 272/118 |
| 4,741,530 | 5/1988 | Wolf | 272/129 X |
| 4,989,861 | 2/1991 | Halpern | 272/129 |

*Primary Examiner*—Robert Bahr
*Attorney, Agent, or Firm*—Frank D. Gilliam

[57] ABSTRACT

A static rebound exerciser/rehabilitation device for exercising a person regardless of that persons physical condition and particularly for exercising an invalid person. A base platform supports a pair of vertical uprights which have a pivotly attached person supporting boom extending therefrom. The boom is positionable vertically by a hydraulic actuator or jack. A pair of leaf springs are attached to the uprights and extend downwardly from fixed in place ends to distal ends. A pair of cables extend from the distal ends of the leaf springs each around a pulley and extend to common termination member to which is attached a person supporting cable which extends from the end of the boom, a dampening spring and a periodically operated solenoid which pulls against the weight of the person supported by one end of the cable. The person supporting cable passes through a pair of pulleys and extends downward from the distal end of the boom. A person attached to the distal end of the person support cable is exercised by action of the solenoid jerking the cable and the flexing of the leaf springs against the weight of the suspended person. The dampening spring is adjustable to control the amplitude of the solenoid action on the cable.

10 Claims, 1 Drawing Sheet

INVALID GRAVITY FORCE REBOUND EXERCISER

This application is a continuation in part of by pending patent application having Ser. No. 07/544,916 filed on Jun. 20, 1990, now U.S. Pat. No. 5,064,191.

BACKGROUND OF THE INVENTION

The invention is directed to a therapeutic exercise/-rehabilitation device and particularly to a rebound exercise device for exercising physically disabled persons regardless of their physical condition by prolonged positive and negative gravity stressing.

It is generally excepted that the human body, its components, and functions are stressed, stimulated and thereby strengthened in all activities involving resistance to the extent gravitational pull or force. The human body does not physiologically discern between the forces of inertia, acceleration, deceleration and gravitational pull.

When humans run, jump, participate in active sports or in any way move in resistance to the force of gravity, the body, its organs and cells are stressed and strengthening is induced. Body fluid circulation and waste functions are also simulated and benefitted. Many people are, however, either disinclined or due to physical impairment or pain cannot participate in the above referenced activity and as a result their bodies and components and functions deteriorate and fail.

The instant invention is directed to those people that require assistance in gravity force activity for maintaining healthy bodies and body components and that force is applied through mechanical apparatus without the assistance of the person being exercised.

A prior art search uncoyered various exercise devices which are taught by U.S. Pat. Nos. 4,111,414; 4,341,380; 4,586,510; 4,505,475; 4,603,855; 4,610,449; 4,720,097; and 4,846,458.

The following Patents teach harnesses for supporting exercisers while performing specific types of exercises U.S. Pat. Nos. 3,937,461; 4,431,184; and 4,410,175.

U.S. Pat. No. 4,341,380 teaches a therapeutic exercise device comprising a base resting on a floor surface and a platform located above the base and maintained rigidly parallel to the base during horizontal through up and down cycles of the platform. A patient to be exercised stands on the platform while the platform is caused to oscillate up and down relative to the base by means of springs or motor a driven reciprocal drive which is fixed in its up and down swing distance and oscillation frequency.

U.S. Pat. No. 4,586,510 teaches the selective exercising of body parts of a paralyzed human by electrical stimulation.

My present pending application utilizes an embodiment of specialized equipment for this purpose. The present invention is a further adaption of different specialized equipment to perform the same and similar concepts of my pending application with further consideration given to equipment storage, weight and economic cost thereof.

There has been a long felt need for an exercising device for disabled persons that simulates the natural exercise encountered by normal and healthy people in their everyday activities and recreation sports while that person being exercised remains passive. The instant invention provides an improved solution to that long felt need and the further consideration of equipment weight to allow increased portability as well as its economic cost.

SUMMARY OF THE INVENTION

The invention is directed to a static rebound exerciser with a base platform for positioning the device and a pair of vertical upright members which are spaced apart at the base platform and are brought substantially together at their vertically upper or top end remote from the base. The vertical upright members are removable attached to the base platform by means of feet or lugs which slidingly engage slots in the base platform. A plurality of cross members are fixedly attached between the two vertical upright members for physical support therebetween. A brace or strut extends from the opposite side of the base platform and removeably attaches or wedges between the base platform and one of the cross members attached between the pair of vertical upright members for supporting them when a person is being exercised on the device. The brace or strut can be easily removed to allow disassembly of the pair of uprights from the base platform for storage or the like.

A lower cross member between the vertical uprights supports a pair of opposed parallel leaf springs fixedly attached to the cross member at their uppermost vertical end with their lower distal ends each attached to a separate cable which extends upward to a common transition member. A cable extends from the opposite vertical upper side of the transition member over a pulley to the end of the boom around a second pulley and downward toward the base platform. The distal end of the cable includes an attachment member, for example a hook, for connecting to a body harness or the like (not shown) for supporting a person for gravity exercising.

A pulley attached to the transition member engages a cable which extends between an adjustable tensioning device in the form of adjustable spring tension and the actuating element of an electrically operated solenoid. The tensioning device can be adjusted to limit the effect of the pull or amplitude on the transition member by the solenoid operation on the person supporting cable extending from the transition member.

In operation, the boom is lowered by the hydraulic actuator until the person to be exercised can be attached to the end of the cable extending from the boom. When attached, the person is elevated by reversing the action of the hydraulic actuator until that person is above the base platform. When the person is in this position the solenoid is energized and the person is oscillated up against gravity by solenoid action and down with gravity by the action of the leaf springs until the desirable amount of exercise is performed on that passive person.

When the desired exercising is completed a reverse boom operation is initiated, the person is lowered from the exercise position to their initial position and removed from the cable end.

An object of this invention is to provide a gravity force exerciser for passive humans which are physical unable to exercise in a normal natural manner due to some infirmity.

Another object of this invention is to provide a gravity force exerciser which can be selectively elevated to exercise persons of various heights.

Another object of this invention is top provide a gravity force exerciser which can accommodate humans of different weights.

Another object of this invention is to provide a gravity force exerciser which the distance of overall vertical up and down movement of a person being exercised can be selectively adjusted through an infinite number of different lengths.

Yet another object of this invention is to provide a gravity force exerciser in which the oscillation can be selectively dampened in amplitude through an infinite range of amplitudes.

Yet another object of this invention is to provide a exercisable device as set out herein that can be substantially dissembled for storage and the like that is economically inexpensive to fabricate.

Still another object of this invention is to set the rate of the oscillation by means of an electrical timer.

These and other objects and advantages of the present invention will become apparent to those skilled in the art after considering the following detailed specification in which the preferred embodiment are described in conjunction with the accompanying drawing Figures.

BRIEF DESCRIPTION OF THE DRAWING FIGURES

FIG. 1 is a detailed end view elevation showing of the device with the person supporting boom removed depicting the operational mechanism thereof and FIG. 2 is a side elevation showing of the gravity force exerciser of the present invention.

DETAILED DESCRIPTION OF THE PREFERRED EMBODIMENT

Figure 1:
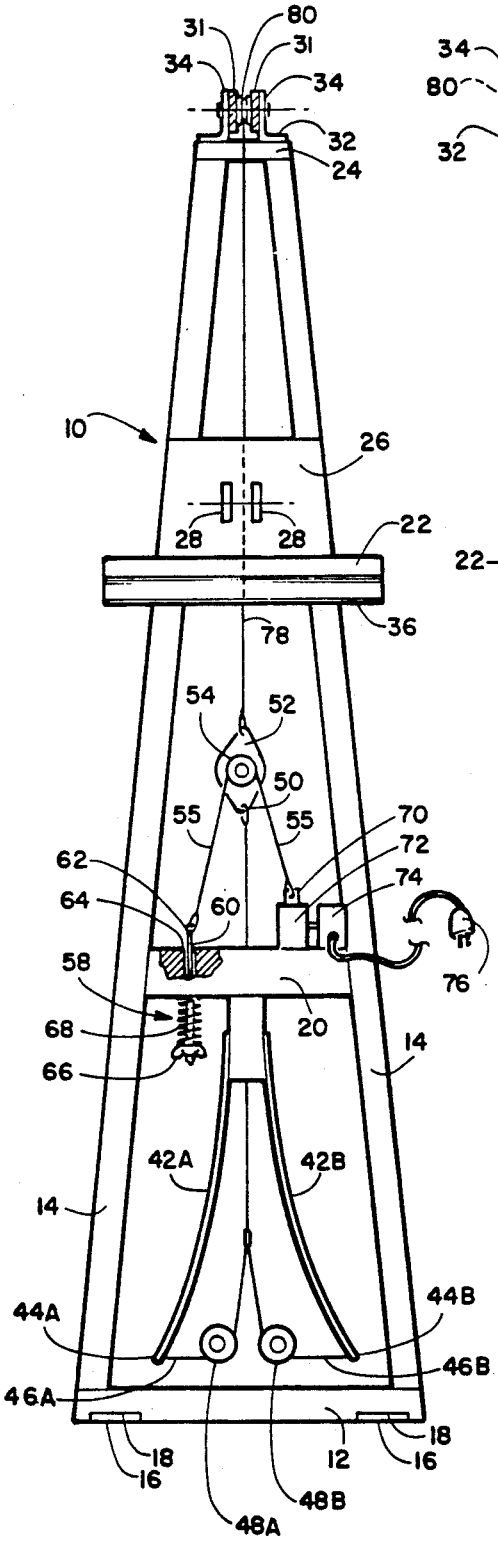
Figure 2:
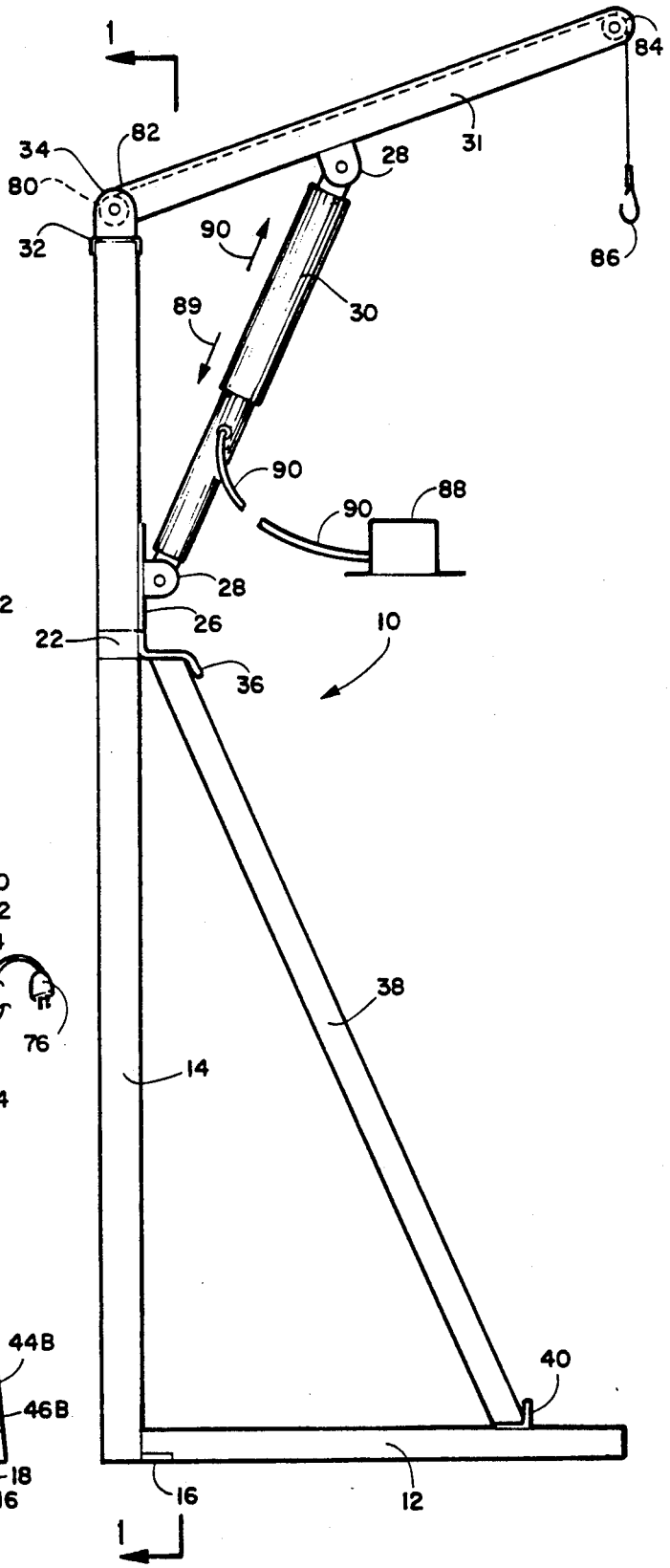

Referring to the drawing FIGS. 1 and 2, showing various details of the exercise device 10 of the present invention. A base platform 12 supports a pair of vertical uprights 14. The uprights 14 are removably attached to the base platform 12 by conventional tongue and groove means. The upright members each have a tongue 16 which is removably insertable into a grove 18 on one side of the base portion. A plurality of cross-member supports 20, 22, and 24 are fixedly secured to the vertical uprights 14 for the purpose of providing physical support therebetween. Additional cross-member supports may be employed depending on the anticipated weight to be supported by the device 10.

Cross-member 22 in addition to adding support to the uprights provides a support plate 26 which includes a pair of opposed flanges 28 for pivotly supporting on end of the hydraulic actuator 30. The other end of the actuator 30 is pivotally attach to a like pair of flanges 28 attached to the under side 30 of the boom 31. These pivotal connections to the flanges allow the boom to be rotationally elevated relative to its pivotal attachment to the end 32 of the pair of vertical uprights through opposed flanges 34 fixedly mounted thereon.

A bracket 36 for receiving and supporting one end of a brace 38 is fixedly attached to cross-member 22. The opposite end of the brace 38 is held in place on the base platform by a bracket 40. The brace 38 provides a support for the upright members when a person is supported by the boom. As can be seen in drawing FIG. 2, the brace 38 can be installed and removed by respectively sliding away from and toward the viewer if the Figure into and from between brackets 36 and 40.

Referring now specifically to drawing FIG. 2, a pair of opposing parallel leaf springs 42A and 42B are fixedly attached to cross-member 20 and extend downwardly therefrom. The distal ends 44A and 44B respectively of the leaf springs are attached to the ends of cables 46A and 46B. The cables 46A and 46B extend around respective pulleys 48A and 48B and extend upward and attach to a common connection 50 to the bottom of transition member 52.

Centrally positioned on the transition member is a rotatable pulley 54. A cable 55 riding on pulley 54 has one end connected to tensioning a device 58. The tensioning device 58 comprises an elongated rod 60 attached at one end 62 of the cable 55. The rod extends through a bore 64 (shown in phantom) in cross-member 20. The distal end of the rod 60 is threaded and has a wing nut 66 threaded thereon. Positioned on the rod 60 and captured between the lower surface of the cross-member 20 and the wing nut 66 is a coils spring 68. The other end of the cable 55 is attached to a solenoid actuated translating member 70 which is periodically extended and withdrawn from a solenoid 72. The period between the extending and withdrawing of the translating member is timed by a timer 74. The solenoid and timer are powered by a convenient AC outlet or the like 76.

The upper central portion of the translation element is attached to a cable 78 which extends upwardly around a pulley 80 at the end 82 of the boom 31, through the center of the boom, around a pulley 84 at the end of the boom and downward toward the platform. A person attachment member 86 (shown as a hook) is attached to the end of the cable 78.

In operation, the boom 31 is lowered by bleeding off any hydraulic pressure behind the piston (not shown) of the actuator into a reservoir, as hereinafter discussed, in a conventional manner and physically pulling the boom down against the actuator piston along arrow 89. When the boom is lowered the person to be exercised is attached to the attachment member 86 and the boom is raised by action of the hydraulic pump 88 moving hydraulic fluid from the hydraulic fluid from its reservoir through interconnecting hydraulic line 90 to one side the aforementioned piston in a conventional manner causing the internal actuator piston to extend the length of the actuator along arrow 90 rotating the boom upwardly until the person attached to the attachment member is elevated above the base platform. With the person to be exercised elevated in this manner, the solenoid and timer is actuated and the cable 78 is caused to pull and release according to the timing of the timer. The amplitude or extent of cable movement is controlled by adjusting of the wing nut on rod 60. Increased spring tension by effectively shortening the length of the rod with the wing nut decreases the amplitude of the cable extension and retraction and effectively extending the length of the rod by counter rotation of the wing nut will increase the amplitude of the cable extension and retraction.

When the exercising of a person is completed action opposite to the above are accomplished to return the person exercised to their former position and location.

The apparatus discussed above can be constructed from any material suitable for the purpose intended.

While there have been shown and described a preferred embodiment in accordance with the invention, it will be appreciated that many changes and modifications may be made therein without, however, departing from the essential spirit thereof.

What is claimed is:

1. A gravity force rebound exerciser attached to a supporting base platform comprising:

a cable means for supporting a person at one end and a biasing means at the other end;

a cable support means for supporting said cable between ends, said support means being selectively elevatable at the person supporting end of said cable for selectively elevating a person attached to said cable to a first position above said supporting base platform, said cable support means comprises a base support member for resting on a support surface, a pair of vertical members removably attached to said base member, a boom pivotally attached to the distal end of said vertical members, and an extendable member pivotly attached to the top of said vertical members whereby when said extendable member is extended said boom is pivoted about its pivotal attachment to said vertical members and a brace member removably extending between said base support member and said vertical members; and cable actuation means for periodically translating said cable back and forth relative to said cable support whereby when said cable translates in a first direction a person attached to the person supporting end of the cable is elevated to a second position above said first position and said biasing means increases its biasing action and when said cable translates in a second direction opposite to said first direction said person is lowered to said first position and said biasing means decreases in bias action.

2. The invention as defined in claim 1 wherein any given weight of a person attached to one end of said cable may be counterbalanced by said biasing means.

3. The invention as defined in claim 1 wherein said cable means includes a means for infinitely adjusting the distance of travel of said cable generated by said means for periodically translating said cable back and forth through a selected range of lengths.

4. The invention as defined in claim 1 further comprising a control means for infinitely controlling the periodic translation of said cable means through a selected range of frequencies.

5. The invention as defined in claim 1 wherein said biasing means comprises a pair of leaf springs.

6. A gravity force rebound exerciser comprising:

a cable means for supporting a person at one end and a biasing means at the other end;

a cable support means for supporting said cable between ends, said support means being selectively elevatable at the person supporting end of said cable for selectively elevating a person attached to said cable; and means for periodically translating said cable back and forth relative to said cable support whereby when said cable translates in a first direction a person attached to the person supporting end of the cable is elevated and said biasing means increases its biasing action and when said cable translates in a second opposite direction said person is lowered and said biasing means decreases in bias action, said biasing means comprises a pair of leaf springs, said leaf springs are juxtaposed in a parallel relative position with one end fixedly attached to said cable support means with the opposite end attached to an the opposite distal end fixedly attached to the end of said cable means remote from the person supporting end.

7. The invention as defined in claim 6 wherein said cable support means comprises a base support member for resting on a support surface, a pair of vertical members removably attached to said base member, a boom pivotally attached to the distal end of said vertical members, an extendable member pivotaly attached to the top of said vertical members whereby when said extendable member is extended said boom is pivoted about its pivotal attachment to said vertical members and a brace member removably extending between said base support member and said vertical members.

8. The invention as defined in claim 6 wherein the weight of said person at one end of said cable is counterbalanced by said biasing means.

9. The invention as defined in claim 6 wherein said cable means includes a means for infinitely adjusting the distance of travel of said cable generated by said means for periodically translating said cable back and forth through a selected range of lengths.

10. The invention as defined in claim 6 further comprising a control means for infinitely controlling the periodic translation of said cable means through a selected range of frequencies.

* * * * *